United States Patent [19]

Hagiwara et al.

[11] Patent Number: 4,800,774

[45] Date of Patent: Jan. 31, 1989

[54] PEDAL-LOAD LIGHTENING APPARATUS

[75] Inventors: Yoshihiko Hagiwara, Sagamihara; Katsumi Ooshima, Yokohama, both of Japan

[73] Assignee: Topre Corporation, Tokyo, Japan

[21] Appl. No.: 17,460

[22] Filed: Feb. 24, 1987

[30] Foreign Application Priority Data

Feb. 27, 1986 [JP] Japan ..... 61-28559[U]
Oct. 27, 1986 [JP] Japan ..... 61-163569[U]

[51] Int. Cl.[4] ..... G05G 1/14

[52] U.S. Cl. ..... 74/512; 192/111 A; 74/531; 74/560

[58] Field of Search ..... 192/111 A; 74/512, 513, 74/514, 519, 531, 540, 560

[56] References Cited

U.S. PATENT DOCUMENTS

| | | | |
|---|---|---|---|
| 3,365,042 | 1/1968 | Smirl et al. | 192/111 A |
| 3,768,612 | 10/1973 | Gale | 192/111 A |
| 3,975,972 | 8/1976 | Muhleck | 74/560 |
| 4,263,999 | 4/1981 | Fasano | 192/111 A |
| 4,310,086 | 1/1982 | Mochida | 192/111 A |
| 4,326,616 | 4/1982 | Mochida et al. | 192/111 A |
| 4,364,284 | 12/1982 | Tani et al. | 74/540 |
| 4,381,053 | 4/1983 | Hyodo | 192/111 A |
| 4,424,890 | 1/1984 | Duethman | 192/111 A |
| 4,708,028 | 11/1987 | Pardy | 74/512 |

FOREIGN PATENT DOCUMENTS

| | | | |
|---|---|---|---|
| 1450194 | 4/1969 | Fed. Rep. of Germany | 192/111 A |
| 2921684 | 12/1980 | Fed. Rep. of Germany | 192/111 A |
| 56-35382 | 8/1981 | Japan | 74/512 |
| 56-46974 | 11/1981 | Japan | 74/512 |
| 56-46975 | 11/1981 | Japan | 74/512 |
| 58-6629 | 1/1983 | Japan | 74/512 |
| 2034854 | 6/1980 | United Kingdom | 192/111 A |

*Primary Examiner*—Richard E. Moore
*Assistant Examiner*—Vinh Luong
*Attorney, Agent, or Firm*—Oblon, Fisher, Spivak, McClelland & Maier

[57] ABSTRACT

A pedal-load lightening apparatus comprising a pedal arm and a lever rockable in one therewith. A torsion coil spring is provided between the lever and a support bracket. The coil spring urges the pedal arm to return to its initial position before the arm, starting from the initial position, reaches a neutral position at a predetermined rotational angle to the initial position. When the neutral position is reached, the spring starts to urge the pedal arm in a treadling direction. Moreover, an urging element is attached to the support bracket or the lever. The urging element is adapted to press the pedal arm in the treadling direction, with a force smaller than the repulsive force of the torsion coil spring, within a stroke of the arm between the initial position and a position near the neutral position.

7 Claims, 6 Drawing Sheets

PEDAL-LOAD LIGHTENING APPARATUS

BACKGROUND OF THE INVENTION

The present invention relates to an apparatus for reducing a treadling force necessary for working a pedal, such as a clutch pedal of an automobile, and more specifically to an improvement of means for urging the pedal.

In conventional pedal-load lightening apparatuses, a torsion coil spring is used as means for urging a pedal. One such apparatus is disclosed in Japanese Utility Model Disclosure No. 58-6629.

In this prior art apparatus, a support shaft is attached to a support bracket, which is fixed to a car body. A pedal arm is rockably supported on the shaft. It has a lever which rocks in one therewith. A torsion coil spring, having first and second ends, is disposed between the free end of the lever and the support bracket. The first end of the spring is rotatably supported on the bracket, while the second end is anchored to the lever.

When the pedal arm is forced in by treadling, the second end of the torsion coil spring moves in the treadling direction from its initial position. Before the second end reaches a critical position at a predetermined rotational angle to the initial position, therefore, the repulsive force of the spring urges the pedal arm to return. When the arm rocks to the critical position, the repulsive force of the coil starts urging the arm to move in the treadling direction. Thus, the necessary treadling force on the pedal can be reduced.

In the prior art apparatus described above, if a torsion coil spring with a larger spring constant or a longer lever is used to increase reduction of the necessary treadling force, the repulsive force of the spring increases, and a greater treadling force is needed in the initial stage of pedaling operation. Thus, the pedal cannot be easily worked at the start.

SUMMARY OF THE INVENTION

The object of the present invention is to provide a pedal-load lightening apparatus which is free of the drawback of the prior art apparatuses.

According to the present invention, there is provided a pedal-load lightening apparatus, which comprises a support bracket including a pair of side plates and a top plate connecting the side plates; a horizontal support shaft extending between the side plates; a pedal arm supported, at the upper end portion thereof, on the support shaft so as to be rotatable around the shaft; a lever attached to the pedal arm so as to be rockable in one therewith; a torsion coil spring provided between the lever and the support bracket, and including at least one coil, a first end rockably supported by one side plate of the support bracket, and a second end anchored to the lever so as to apply an initial torsional moment to the coil, the torsion coil spring being adapted to urge the pedal arm to return to an initial position thereof before the arm reaches a critical position at a predetermined rotational angle to the initial position, and to start urging the pedal arm in the direction of treadling action when the arm reaches the critical position; and an urging element attached to the support bracket or the lever, and adapted to urge the pedal arm in the direction of treadling action thereon, within the stroke of the arm between the initial position and the critical position corresponding to the predetermined rotational angle.

When the pedal arm is forced in, the lever is urged to return to its initial position by the repulsive force of the torsion coil spring, before the arm reaches the critical or neutral position at the predetermined rotational angle to the initial position. At the same time, however, the lever is urged also in the treadling direction by the urging element. Therefore, the necessary treadling force in the initial stage of pedaling operation is equivalent to the difference between the respective reaction forces of the coil spring and the urging element. If the pedal arm is further forced in, thus reaching the neutral position, the lever starts to be urged in the treadling direction by the repulsive force of the torsion coil spring. When the arm reaches a position near the neutral position, the urging element ceases from urging the lever. Thus, the necessary treadling force in the initial stage of the pedaling operation can be reduced.

In consequence, the magnitude of the initial treadling force can be selected freely, without depending on the resilience of the torsion coil spring. Both the coil spring and the urging element are relatively small-sized, and the latter can be attached to the support bracket or the lever. Accordingly, the pedal-force lightening apparatus of the present invention can enjoy a compact design.

DETAILED DESCRIPTION OF THE PREFERRED EMBODIMENTS

Figure 1:
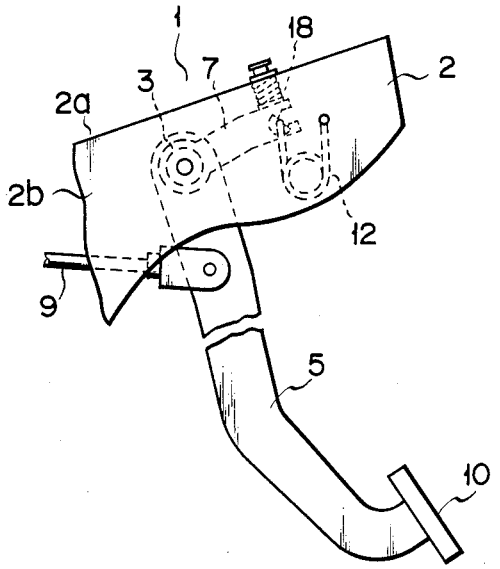
FIG. 1 is a side view of a clutch pedal system of an automobile according to a first embodiment of the present invention.

FIGS. 1 to 4 show a first embodiment of the present invention. Referring now to FIG. 1, there is shown pedal-load lightening apparatus 1, in which support bracket 2 is fixed to a car body (not shown). Bracket 2 includes top plate 2*a* and a pair of side plates 2*b* and 2*c*. Support shaft 3 stretches between plates 2*b* and 2*c*. Cylindrical portion 4 of pedal arm 5 is mounted on shaft 3 so as to be rotatable around the shaft.

Cylindrical portion 4 is provided at the basal part of pedal arm 5. Also, the basal part of lever 7 is fixed to portion 4. One end of push rod 9 is coupled to arm 5 by means of clevis 8. A master buck (not shown) is connected to the other end of rod 9. It has functions to engage or disengage a clutch plate (not shown), and to restore rocked pedal arm 5 to its original position. Treadle 10 is attached to the lower end of arm 5. Notch 11 is formed at the free end of lever 7.

Figure 13:
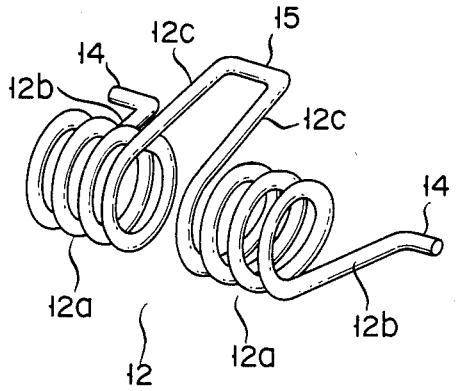
FIG. 13 is a perspective view of the torsion coil spring shown in FIG. 1.

Tension coil spring 12 is provided between notch 11 and support bracket 2. As is shown in FIG. 13, spring 12 consists of two identical parts. Each part is made of a coil 12*a* and two arms 12*b* and 12*c* connected to the ends of coil 12*a*, respectively. The one end portion 14 of arm 12*b* is bent at right angles. The other end portion 15 of arm 12*c* is also bent at right angles. The two identical parts of spring 12 are connected at end 15 to each other. Bent end portion 14 of first part is inserted in hole 2*d* cut in side plate 2*b* of support bracket 2. The other bent end portion 15 of first part is fitted in notch 11 of lever 7. Similarly, bent end portion 14 of second part is inserted in hole 2*d* cut in side plate 2*c* of support bracket 2. The other bent end portion 15 of second part is fitted in notch 11 of lever 7. Plastic spacer 16 is interposed between notch 11 and portions 15 of both parts of spring 12, and plastic spacer 17 is interposed between hole 2*d* of side wall 2*b* and portion 14 of the first part, and another plastic spacer 17 is interposed between hole 2*d* of side wall 2*c* and portion 14 of the second part. These spacers 16 and 17 help to ease friction of the rotation of portions 14 and 15 of spring 12.

Torsion coil spring 12 is provided in a torsional manner, between support bracket 2 and lever 7, so that the angle between arms 12*b* and 12*c* are narrower than in a free state. If pedal arm 5 rocks in the direction of arrow P, second end portion 15 is shifted from an initial position (indicated by segment A) through a critical or neutral position (indicated by line segment B) to the side of full-treadling position C. Segment B connects the center of support shaft 3 and first end portion 14.

Thus, if pedal arm 5 rocks in the direction of arrow P, the repulsive force of torsion coil spring 12 acts as means for urging the arm 5 in the direction of arrow R before second end portion 15, starting from initial position A, reaches neutral position B. When end portion 15 reaches position B, the repulsive force of spring 12 starts acting as means for urging the arm 5 in the direction of arrow P, in contrast with the aforesaid case.

Urging element 18, which comprises a second urging means, is interposed between support bracket 2 and lever 7. Element 18 includes compression coil spring 19. Guide pin 20 is passed through spring 19 along its axis. Pin 20 is also passed through hole 22 of ring-shaped supporting member 21, which is provided on top plate 2*a* of bracket 2. Upper and lower collar portions 23 and 24 are formed individually on two opposite ends of guide pin 20. Spring 19 is compressed between lower collar portion 24 and bracket 2. The outside diameter of upper collar portion 23 is greater than the diameter of hole 22 of member 21. Thus, even though lever 7 is disengaged from urging element 18, the element never comes off support bracket 2.

Before lever 7 rocks from initial position A to a position near neutral position B, pedal arm 5 is urged in the direction of arrow P by urging element 18. The repulsive force of element 18 is smaller than that of torsion coil spring 12. While lever 7 is located between positions A and B, therefore, coil spring 19 of element 18 is compressed by lever 7. After passing position B, lever 7 leaves lower collar portion 24.

The operation of pedal-load lightening apparatus, constructed in this manner, will now be described.

Figure 2:
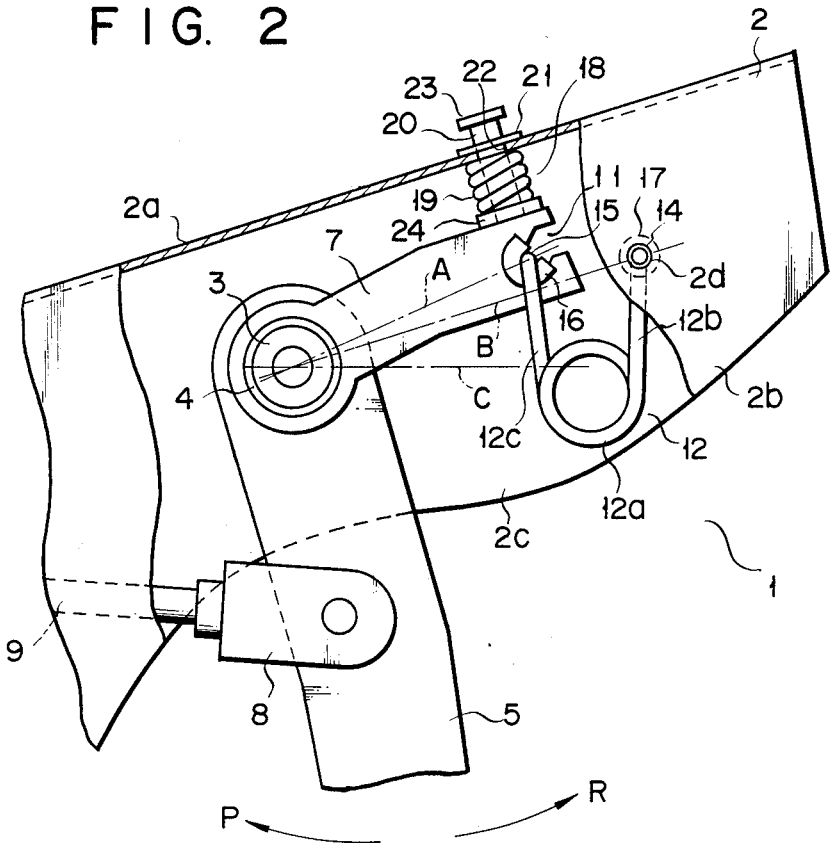
FIG. 2 is a cutaway side view of a pedal-load lightening apparatus shown in FIG. 1.
Figure 3:
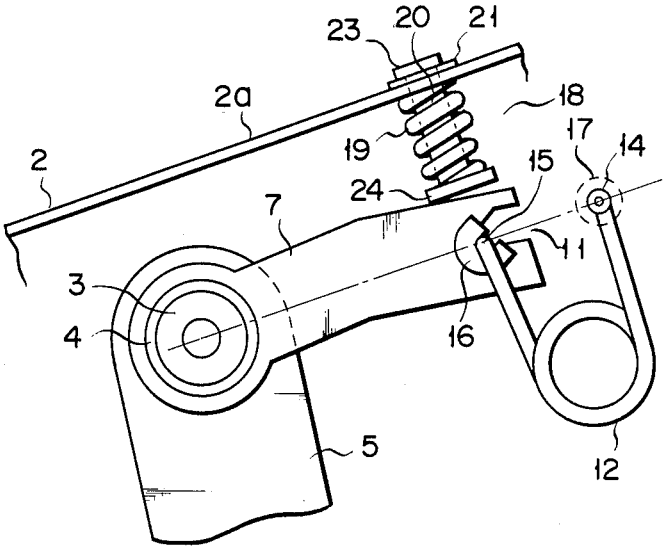
FIG. 3 is a side view of the pedal-load lightening apparatus, in which a lever shown in FIG. 1 is rocked to its critical or neutral position.

If treadle 10 is worked to rock pedal arm 5 in the direction of arrow P, the repulsive force of torsion coil spring 12 urges arm 5 to return in the direction of arrow R, before lever 7 is shifted from the position of FIG. 2 to the position of FIG. 3. At the same time, however, arm 5 is urged in the direction of arrow P by urging element 18. Thus, a reaction force (indicated by full line m in FIG. 5), produced during the time interval between the start of treadling operation and the arrival at the turnover point, is equivalent to a resultant force combining the repulsive force (indicated by broken line) from spring 12 and the repulsive force (indicated by two-dot chain line) from element 18. Accordingly, initial necessary pedaling force R1 is given by $$R1 = R2 - P2,$$

where R2 is the R-direction force from spring 12, and P2 is the P-direction force from element 18. Thus, the initial necessary force for pedaling is reduced.

Figure 4:
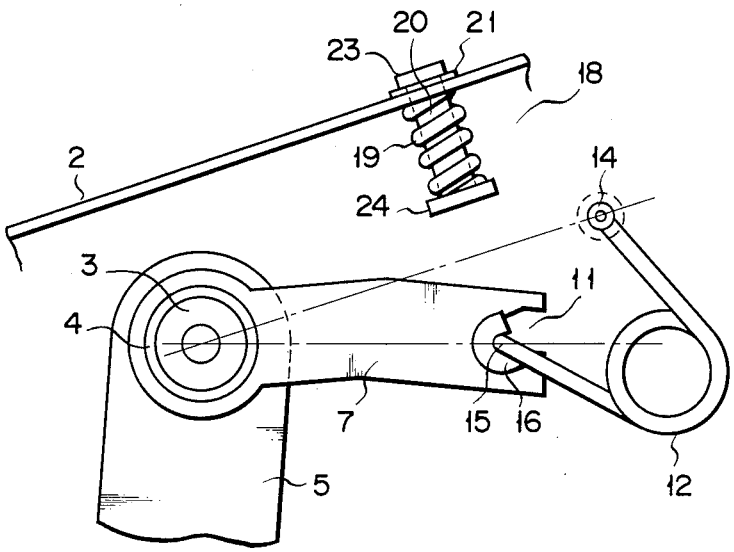
FIG. 4 is a side view of the pedal-load lightening apparatus, in which the lever is forced in further to rock from the neutral position.
Figure 5:
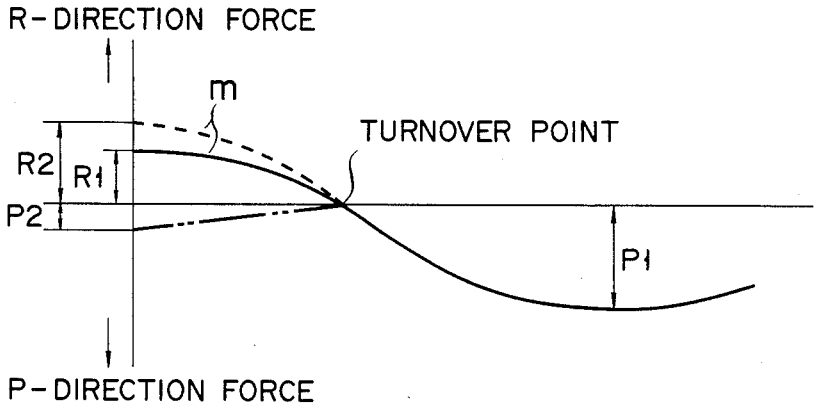
FIG. 5 is a diagram showing a transition of a reaction force in the pedal-load lightening apparatus.

When second end portion 15 of arm 12*b* rocks nearly to the position where it passes neutral position B, the repulsive force of urging element 18 ceases from acting on lever 7. When lever 7 is disengaged from element 18, as shown in FIG. 4, the urging element cannot press pedal arm 5 in the direction of arrow P. When second end 15 substantially passes neutral position B, the repulsive force 12 of torsion coil spring 12 starts to urge arm 5 in the direction of arrow P. As a result, the necessary pedaling force is reduced. In FIG. 5, symbol P1 indicates the maximum reduction of necessary pedaling force or pedal load.

Maximum pedal-load reduction P1 can be increased by making lever 7 longer than in the case of the aforementioned embodiment, or by enhancing the spring constant of torsion coil spring 12. In this case, an increase of initial necessary pedaling force R1 is prevented by using urging element 18 with a larger spring constant than that used in the above embodiment.

Figure 6:
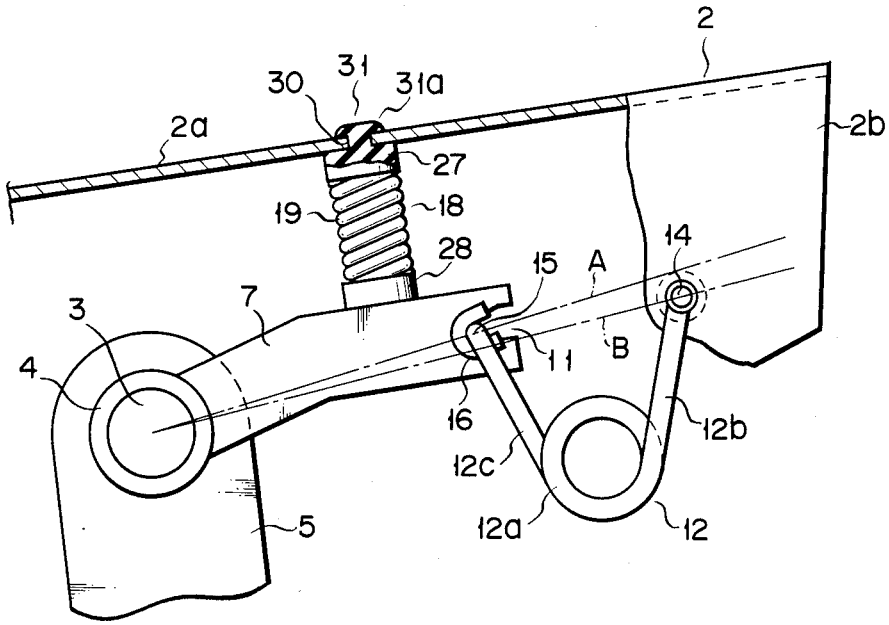
FIG. 6 is a cutaway side view of a pedal-load lightening apparatus according to a second embodiment of the invention.

A second embodiment of the present invention, as shown in FIG. 6, is different from the first embodiment in the arrangement of urging element 18. Element 18 of the second embodiment is provided with plastic members 27 and 28 attached individually to two opposite end portions of compression coil spring 19. Members 27 and 28, which may alternatively be made of rubber, is formed on the end portions of spring 19 by molding.

Figure 7:
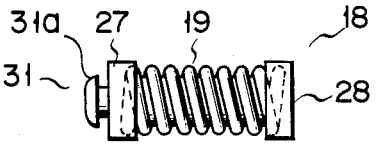
FIG. 7 is a side view of an urging element shown in FIG. 6.

As shown in FIG. 7, plastic member 27 is formed with projection 31, which is fitted in a hole 30, bored through a suitable portion of support bracket 2. Projection 31 includes large-diameter portion 31*a* capable of elastic deformation. In attaching urging element 18 to hole 30 of bracket 2, portion 31*a* is forced strongly into hole 30. When it clears hole 30, the large-diameter portion expands into its original shape. Thus, urging element 18 of the second embodiment can be attached easily to support bracket 2 with the aid of projection 31, and requires fewer components. With respect to other arrangements and functions, the first and second embodiments have no differences. In the accompanying drawings, therefore, like reference numerals refer to like portions throughout the several views, for simplicity of illustration.

Figure 8:
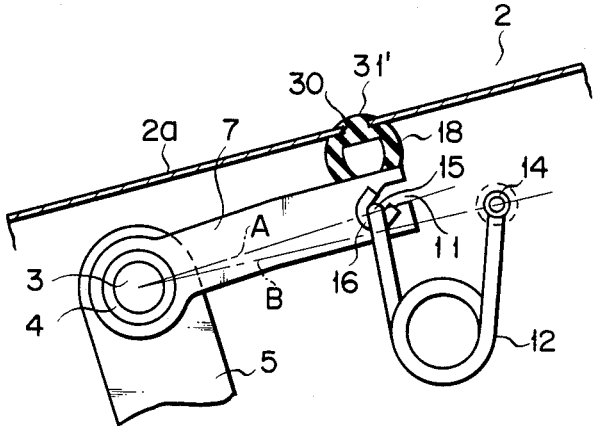
FIG. 8 is a cutaway side view of a pedal-load lightening apparatus according to a third embodiment of the invention.

In a third embodiment of the present invention, as shown in FIG. 8, urging element 18 is an integral molding formed of elastomer, such as a polyurethane elastomer. Although element 18 is shown as being hollow in FIG. 8, it may alternatively be solid. Large-diameter portion 31' is formed at the basal part of element 18. Portion 31' is adapted to be fitted in hole 30 of support bracket 2. If it is forced strongly into hole 30, portion 31' expands into its original shape after clearing hole 30. Thus, urging element 18 can be attached easily to bracket 2 with the aid of large-diameter portion 31', and requires use of only one component. In any of first to third embodiments, urging element 18 may alternatively be attached to lever 7.

Figure 9:
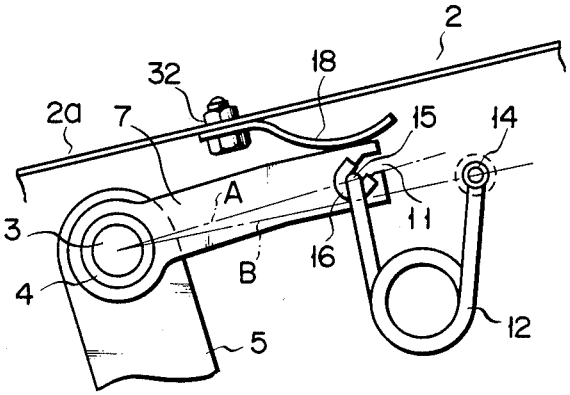
FIG. 9 is a side view of a pedal-load lightening apparatus according to a fourth embodiment of the invention.

In a fourth embodiment shown in FIG. 9, moreover, urging element 18 is in the form of a leaf spring, made of metal. It is fixed to support bracket 2 by means of fixing member 32, such as a screw. The urging element or leaf spring urges lever 7, in initial position A, toward neutral position B.

Figure 10:
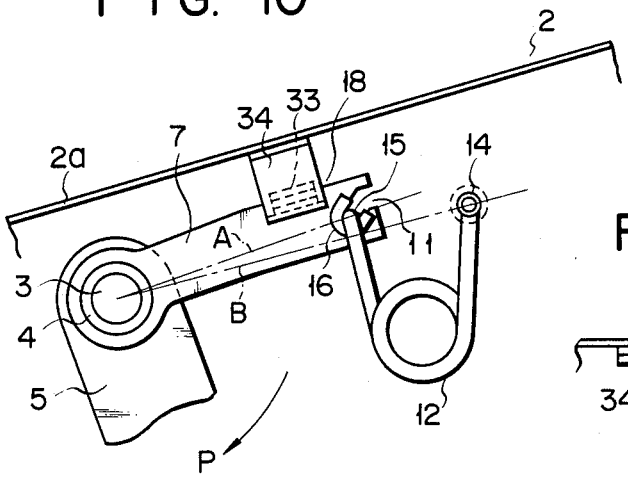
FIG. 10 is a side view of a pedal-load lightening apparatus according to a fifth embodiment of the invention.
Figure 11:
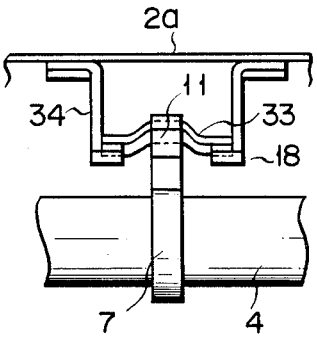
FIG. 11 is a partial front view of the apparatus shown in FIG. 10.

In a fifth embodiment shown in FIGS. 10 and 11, urging element 18 includes elastomer plate 33. Two opposite end portions of plate 33 are fixed individually to a pair of brackets 34, which are fixed to top plate portion 2a of support bracket 2. When the upper edge of lever 7 abuts against plate 33, the plate bends, so that lever 7 is urged in the direction of arrow P by the restoring force of the elastomer plate.

Figure 12:
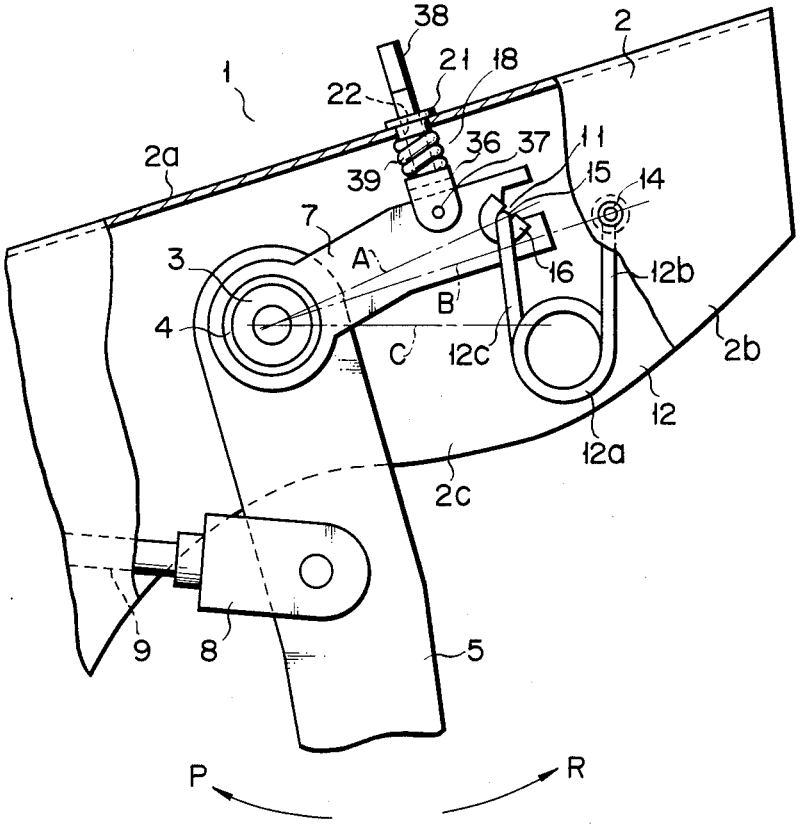
FIG. 12 is a cutaway side view of a pedal-load lightening apparatus according to a sixth embodiment of the invention.

In a sixth embodiment shown in FIG. 12, one end side of clevis 36 of urging element 18 is attached to lever 7 by means of pin 37. Guide pin 38 is coupled to the other end side of clevis 36. Pin 38 is movably passed through hole 22 of supporting member 21, which is provided on top plate 2a of support bracket 2. Pin 38 is long enough to be able to be kept engaged with hole 22 if lever 7 is disengaged from pin 38. Compression coil spring 39 is disposed between clevis 36 and top plate 2a. While lever 78 is located between initial position A and a position near neutral position B, spring 39 urges the lever toward position B. The functions and effects of this embodiment are substantially the same as those of the first embodiment.

In any of first to sixth embodiments, urging element 18 is located between top plate 2a of support bracket 2 and lever 7, so that it requires only a narrow mounting space. Moreover, element 18 can be located in a position where it is not in contact with a wire (not shown) or push rod 9 for engaging and disengaging the clutch plate. Accordingly, the mounting positions of the wire and rod 9 are not restricted at all by the urging element. In any of the second, third, and fifth embodiments, a nonmetallic material, such as a polyurethane, is used for urging element 18. Even though lever 7 runs against element 18, therefore, the collision produces no substantial noise.

Lever 7 may be formed on part of pedal arm 5. Alternatively, two levers 7 may be mounted on support shaft 3. In this case, torsion coil spring 12 is disposed between support bracket 2 and one of levers 7, while urging element 18 is located between bracket 2 and the other lever.

Figure 14:
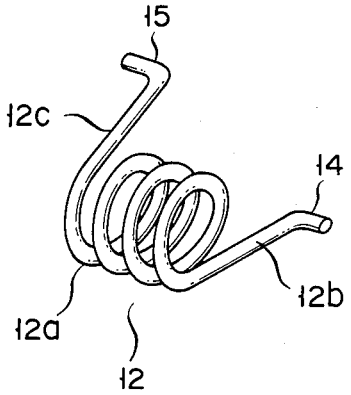
FIG. 14 is a perspective view of the torsion coil spring in a deformed condition.

The present invention is not limited to the embodiments described above. For instance, coil spring 12 can include only one coil 12a, as is shown FIG. 14.

What is claimed is:

1. A pedal-load lightening apparatus for reducing a necessary treadling force on a pedal, comprising:

a support bracket including a pair of side plates and a top plate connecting the side plates;

a horizontal support shaft extending between the side plates;

a pedal arm supported, at the upper end portion thereof, on the support shaft so as to be rotatable around the shaft;

a lever attached to the pedal arm so as to be rockable therewith;

a torsion coil spring provided between the lever and the support bracket, and including at least one coil, a first end rockably supported by one side plate of the support bracket, and a second end anchored to the lever so as to apply an initial torsional moment to the coil, said torsion coil spring comprising means for urging the pedal arm to return to an initial position thereof before the arm reaches a critical position at a predetermined rotational angle to the initial position, and for urging the pedal arm in the direction of treadling action when the arm passes the critical position during movement from said initial position in the direction of treadling action, the second end of said torsion coil spring being located on one side of a line segment connecting the center of the support shaft and the first end when the pedal arm is in the initial position, and being located on a side opposite said one side, with respect to the line segment after the pedal arm has moved past said critical position during movement in the direction of treadling action; and an urging element positioned between the support bracket and the lever, and comprising second means for urging the pedal arm in the direction of treadling action thereof throughout substantially all of the predetermined rotational angle between the initial position and the critical position.

2. The pedal-load lightening apparatus according to claim 1, wherein said urging element includes a compression coil spring and a member for fixing the compression coil spring to the top plate portion of the support bracket.

3. The pedal-load lightening apparatus according to claim 1, wherein said urging element includes a compression coil spring and a pair of elastomer members attached individually to two opposite end portions of the compression coil spring, one of said elastomer members being fixed to the top plate of the support bracket, and the other elastomer member facing the lever.

4. The pedal-load lightening apparatus according to claim 1, wherein said urging element is an integral elastomer molding, and the top plate of said support bracket is formed with a hole in which the upper end portion of the elastomer urging element is inserted to be fixed, the lower end portion of said urging element facing the lever.

5. The pedal-load lightening apparatus according to claim 1, wherein said urging element is a metallic leaf spring having a fixed end, fixed to the top plate portion of the support bracket, and a free end facing the lever.

6. The pedal-load lightening apparatus according to claim 1, wherein said urging member is an elastomer plate, and bracket means is fixed to the top plate of the support bracket so as to protrude downward therefrom, so that two opposite end portions of the elastomer plate are fixed to the bracket means, the central portion of said elastomer plate facing the lever.

7. The pedal-load lightening apparatus according to claim 1, wherein said urging member includes a compression coil spring and a guide pin inserted therein along the axis thereof, the lower end side of said guide pin being coupled to the lever, and the top plate of said support bracket is formed with a hole in which the guide pin is inserted for axial movement.

* * * * *